US005634717A

United States Patent [19]

Fraczek et al.

[11] Patent Number: 5,634,717

[45] Date of Patent: Jun. 3, 1997

[54] BULK MIXING FLOW DIVERTER

[75] Inventors: Richard M. Fraczek, Brockport; Frank M. Smola, Rochester, both of N.Y.

[73] Assignee: Eastman Kodak Company, Rochester, N.Y.

[21] Appl. No.: 566,355

[22] Filed: Dec. 1, 1995

Related U.S. Application Data

[60] Provisional application No. 60/001,424 Jul. 25, 1995.

[51] Int. Cl.[6] ..... B01F 5/12; B01F 7/22

[52] U.S. Cl. ..... 366/262; 366/302

[58] Field of Search ..... 366/64, 65, 253, 366/262–265, 270, 279, 281–284, 302, 315–317, 330.1, 348, 349

[56] References Cited

U.S. PATENT DOCUMENTS

| | | | |
|---|---|---|---|
| 1,311,964 | 8/1919 | Grosvenor . | |
| 1,703,099 | 2/1929 | Craddock . | |
| 1,768,927 | 7/1930 | Peters . | |
| 1,913,654 | 6/1933 | Beach . | |
| 1,934,716 | 11/1933 | Jewett | 366/262 X |
| 2,157,683 | 5/1939 | Vollrath . | |
| 2,209,287 | 7/1940 | Simpson . | |
| 2,212,261 | 8/1940 | Brothman | 366/264 |
| 2,376,722 | 5/1945 | Podell . | |
| 3,068,186 | 12/1962 | Paulus et al. . | |
| 3,223,389 | 12/1965 | Simmonds . | |
| 3,297,309 | 1/1967 | Adams | 366/270 |
| 3,425,835 | 2/1969 | Johnson et al. . | |
| 3,865,353 | 2/1975 | Fischer . | |
| 4,049,243 | 9/1977 | Kramer . | |
| 4,155,656 | 5/1979 | Kramer . | |
| 4,155,657 | 5/1979 | King et al. | 366/302 X |
| 4,175,871 | 11/1979 | Suh et al. . | |
| 4,396,291 | 8/1983 | Simmonds . | |
| 4,676,654 | 6/1987 | Fleckner . | |
| 4,730,938 | 3/1988 | Dunn . | |
| 5,037,209 | 8/1991 | Wyss . | |

FOREIGN PATENT DOCUMENTS

| | | | |
|---|---|---|---|
| 3-56132 | 3/1991 | Japan | 366/302 |

*Primary Examiner*—Charles E. Cooley
*Attorney, Agent, or Firm*—Arthur H. Rosenstein; Mark G. Bocchetti

[57] ABSTRACT

A mixer includes a shaft having first end and a second end. An impeller is mounted to the second end of the shaft while the shaft is rotated by a motor attached to the first end. The mixer includes a mixer support shaft and mounting bracket for mounting a diverter between the first end and the second end of the shaft.

5 Claims, 3 Drawing Sheets

BULK MIXING FLOW DIVERTER

CROSS REFERENCE TO RELATED APPLICATION

Reference is made to and priority claimed from U.S. Provisional Application Ser. No. U.S. Ser. No. 60/001,424, filed 25, Jul. 1995, entitled MIXER.

FIELD OF THE INVENTION

The present invention relates generally to the field of mixing. More particularly, the present invention is a mixer that minimizes vortexing and air entrainment in the mixing of a liquid contained in a kettle.

BACKGROUND OF THE INVENTION

In the mixing of photographic emulsions, it is important that air not be entrained into the emulsion. It is also important that the photographic emulsion be mixed thoroughly. This requires high speed mixing; however high speed mixing tends to generate air entrainment. Thus there is a need for a mixer which can be operated at high speed yet does not entrain air during mixing.

Moreover, in the batch manufacturing of photographic emulsions it is important to be able to change from one product to another quickly. Thus the use of fixed baffles within a kettle used for mixing photographic emulsions is not desired. Such a kettle having baffles is hard to clean, and can cause subsequent contamination of future batches of photographic emulsions.

The present invention solves the above-identified problems by providing a mixer that can be operated at high speed, and can be used in a baffleless kettle, while eliminating vortexing and swirling in the liquid being mixed.

SUMMARY OF THE INVENTION

The present invention is a mixer which includes a shaft having a first end and second end. An impeller is attached to the second end of the shaft. Mounting means are positioned between the first end and the second end of the shaft and at least one diverter is mounted to the mounting means positioned transversely to the shaft.

The present invention also includes a method of mixing a liquid. The liquid is contained in a container. A mixer is inserted into the liquid and the mixer includes a shaft having a first end and a second end, an impeller attached to the second end of the shaft, and mounting means positioned between the first end and second end of the shaft. At least one diverter is mounted to the mounting means positioned transversely to the shaft. The shaft is then rotated with the diverter oriented towards a closest wall of the container.

For a better understanding of the present invention together with other advantages and capabilities thereof, references made to the following detailed description and appended claims in connection with the preceding drawings description of some aspects of the invention.

DETAILED DESCRIPTION OF THE PREFERRED EMBODIMENTS

Figure 1:
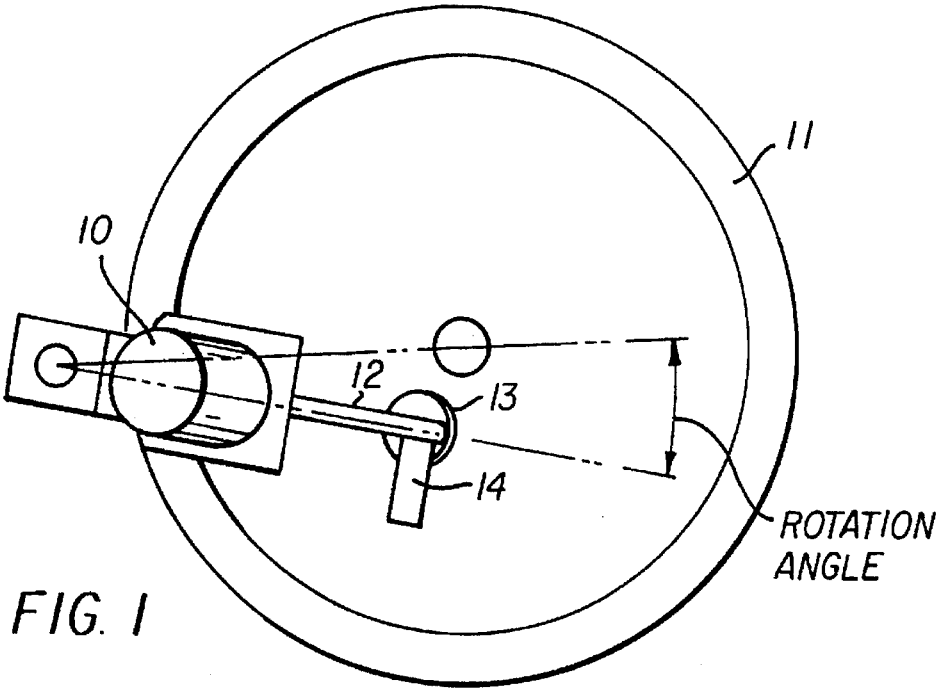
FIG. 1 shows a top view of the mixer of the present invention mounted on a mixing kettle.

Shown in FIG. 1 is the mixer of the present invention. This mixer has been designed to eliminate vortexing and swirling in a process kettle over a large range of mixer positions and mixer speeds. During the manufacture of photographic emulsions, it is typical for mixing to occur in baffleless kettles. It is also typical that the mixer be in an off center slant mounted position. Since the kettle has no baffles, mixer positioning is critical to attain good bulk agitation without short circuiting, vortexing or dead zones. The present invention provides a mixer which accomplishes this.

Figure 2:
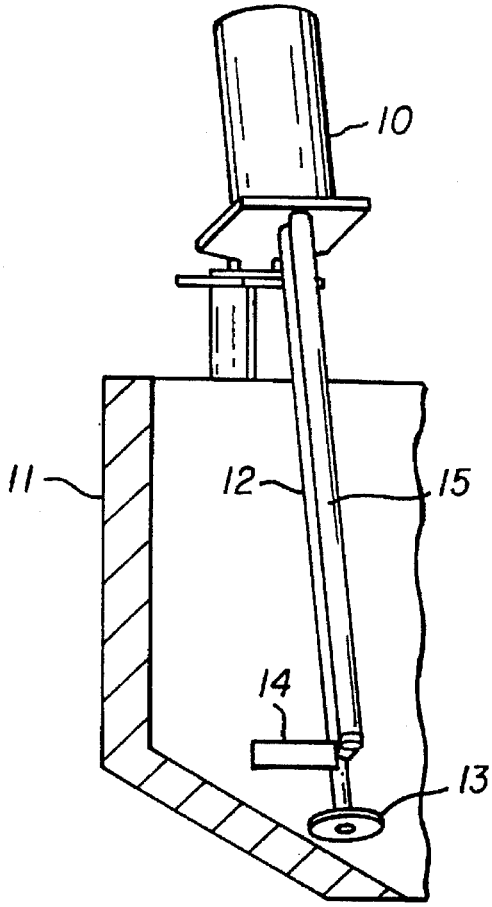
FIG. 2 shows a sectional view of the mixer of the present invention in a mixing kettle.
Figure 3A:
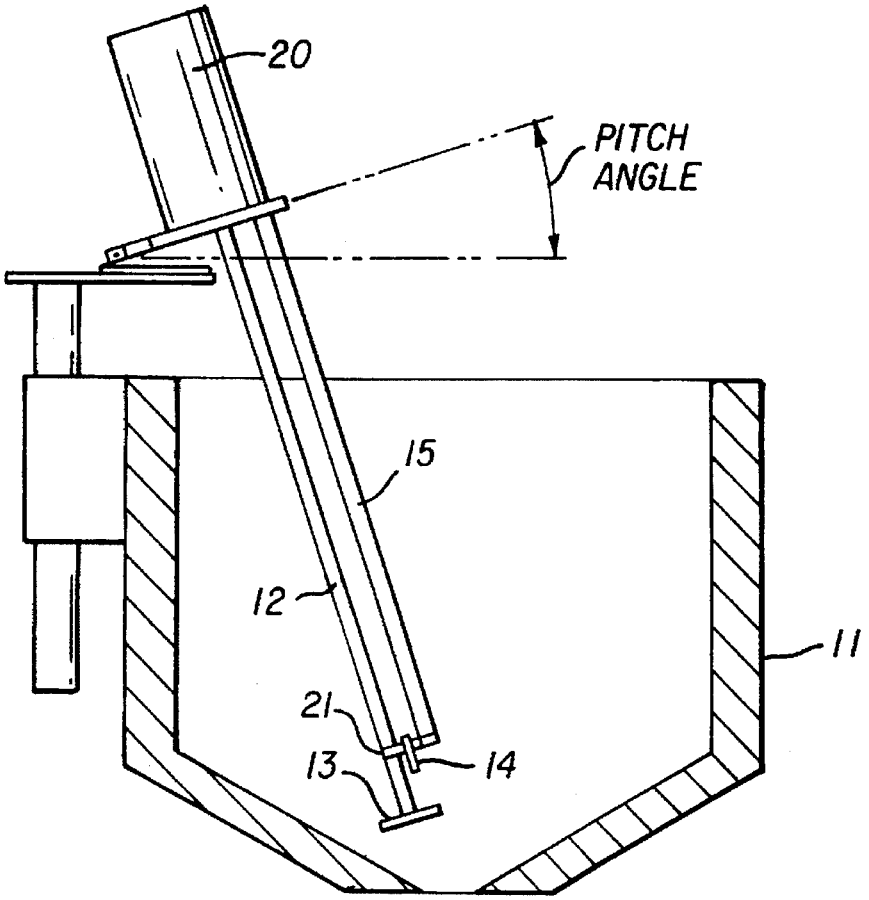
FIG. 3*a* shows an alternate sectional view of the mixer of the present invention mounted in a mixing container.

As shown in FIG. 1, the mixer 10 of the present invention is inserted in a off center position in a kettle 11. The mixer 10 includes a shaft 12, and an agitator 13. The agitator can be a flat blade turbine, a pitched blade turbine, a marine propeller or any other known device attached to a shaft. Also mounted between the motor and the impeller is a diverter 14 with openings which is pointed toward the shaft and, depending on the fluid volume in the kettle, is partially or totally submerged in the fluid. The diverter has planar faces as shown in FIGS. 2 and 3*a*. As shown in FIG. 1, the mixer is mounted at a rotation angle from the center of the kettle.

Figure 3B:
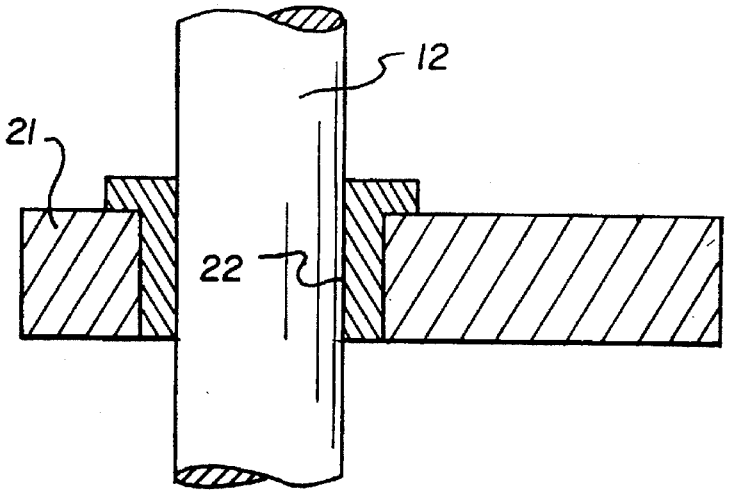
FIG. 3*b* shows the configuration of the mounting bracket and collar.

FIG. 2 is a sectional view showing the mixer 10 of the present invention. A mounting means 15 which runs substantially parallel to the shaft 12 is used to mount the diverter 14. The mounting means comprises a mixer support shaft is spaced from the mixer shaft by a mounting bracket. The mixer support shaft 15 is positioned substantially parallel to the mixer shaft 12. As shown in FIG. 3*a*, the mounting means preferably comprises a collar 22 surrounding the mixer shaft 12. FIG. 3*a* shows another sectional view of the mixer of the present invention in a kettle 10. In FIG. 3*a* it is easy to see the pitch angle that the mixer is mounted at. The shaft of the mixer 12 is attached to a motor 20 which is used to rotate the shaft. The configuration of the mounting bracket 21 and collar 22 is shown in FIG. 3*b*. The diverter 14 is mounted to the mounting bracket 21 and the planar faces are positioned perpendicular to the mounting bracket 21.

As shown in FIGS. 1–3*a*, the mixer 10 is mounted so that the diverter 14 is oriented towards the closest wall of the kettle. This is generally where the vortex swirling will occur if the diverter was not included in the mixer.

Tests were run with water at the minimum kettle volume to evaluate the effects of the mixer position on bulk mixing. Mixing was deemed acceptable if a roll was observed and unacceptable vortexing and/or swirling was observed. A roll is defined as the condition where a bottom to top movement of fluid around the periphery of the kettle wall is obtained. Vortexing is defined as the condition where an air funnel or cone extending into the mixer is observed. Swirling is defined as a condition where an overall clockwise or counterclockwise fluid rotation occurs. Neither vortexing or swirling is an acceptable mixing regime as vortexing results in excessive aeration of a photographic emulsion. Vortexing and swirling can also damage the mixer assembly hardware. Moreover, swirling results in poor chemical dispersal within a photographic emulsion.

Figure 4:
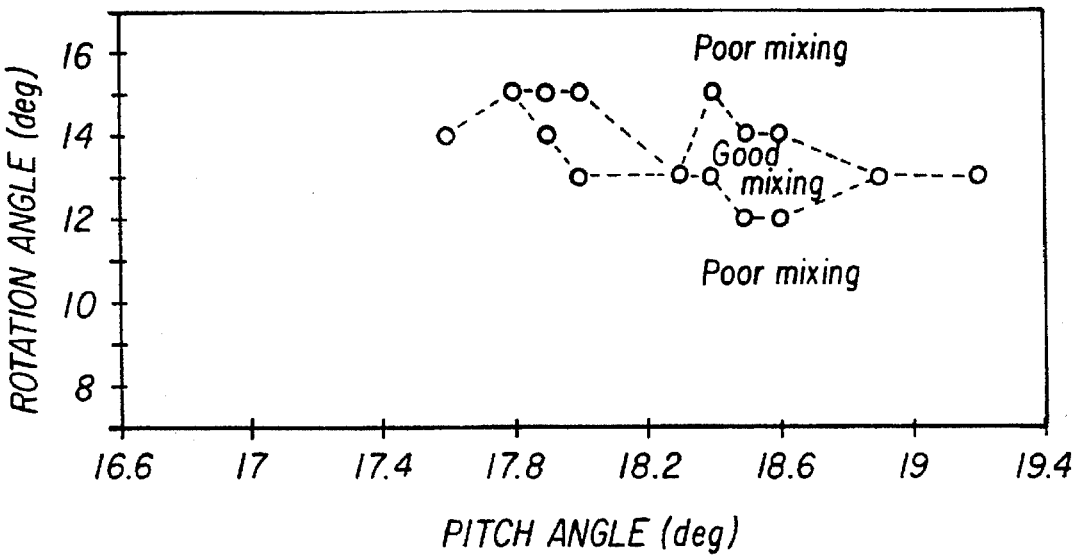
FIG. 4 shows a graph of pitch angle versus rotation angle for mixing water with the mixer of the prior art.
Figure 5:
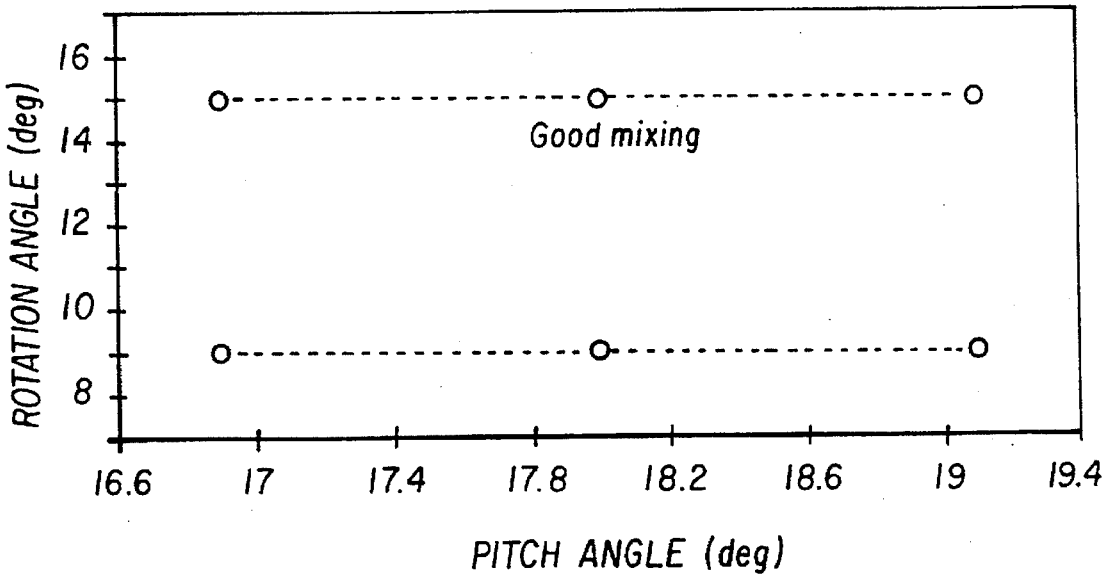
FIG. 5 shows a graph of pitch angle versus rotation angle for the mixer of the present invention.

Shown in FIGS. 4 and 5 are comparisons between a mixer having no diverter and the mixer of the present invention.

Tests were run with water over a wide range of mixer speeds. As shown in FIG. 4 there is a very limited range of pitch angle and rotation angle where acceptable mixing occurred. Meanwhile, in FIG. 5 there is a wide range over which pitch angle and rotation angle produced acceptable mixing. In fact, the only limitations shown in FIG. 5 were due to limitations in changing the rotation angle or the pitch angle.

Unacceptable mixing was generally manifested by the formation of a vortex near the mixer. To impede the formation of a vortex the diverter is mounted near the mixer. This resulted in a significant increase in the pitch and rotation angle and mixer speed range over which acceptable mixing was attained. Advantages of the diverter include a more robust mixer positioning and use of higher mixer speeds with no degradation in bulk mixing.

While there has been shown and described what are presently considered to be the preferred embodiments of the invention, it would be apparent to those skilled in the art the various changes and modification can be made herein without departing from the scope of the invention as defined by the appended claims.

What is claimed is:

1. A mixer comprising a mixer shaft having a first end and a second end;

an impeller attached to the second end of the shaft;

a shaft mixer support shaft positioned substantially parallel to the mixer shaft and spaced from the mixer shaft by a mounting bracket and said mixer support shaft being positioned between the first end of the shaft and the second end of the shaft; and at least one diverter mounted to the mounting bracket and having a planar face;

the face of the diverter is positioned perpendicular to the mounting bracket.

2. The mixer according to claim 1 further comprising a motor positioned at the first end of the shaft.

3. The mixer according to claim 1 wherein the mounting bracket comprises a collar surrounding the shaft.

4. The mixer according to claim 1 wherein the impeller comprises a propeller.

5. A method of mixing a liquid comprising containing the liquid in a container;

inserting a mixer into the liquid, the mixer comprising a mixer shaft having a first end and a second end;

an impeller attached to the second end of the mixer shaft;

a mixer support shaft positioned substantially parallel to the mixer shaft and spaced from the mixer shaft by a mounting bracket and said mixer support shaft being positioned between the first end of the shaft and the second end of the shaft; and at least one diverter mounted to the mounting bracket and having a planar face; the face of the diverter is positioned perpendicular to the mounting bracket;

rotating the mixer shaft with the at least one diverter oriented toward a closest wall of the container.

* * * * *